United States Patent [19]

D'Arcy et al.

[11] Patent Number: 4,750,223

[45] Date of Patent: Jun. 14, 1988

[54] PORTABLE CRIB

[75] Inventors: Daniel J. D'Arcy, Lancaster; Stanley M. Kujawski; David G. Waples, both of East Aurora, all of N.Y.

[73] Assignee: The Quaker Oats Company, Chicago, Ill.

[21] Appl. No.: 93,070

[22] Filed: Sep. 1, 1987

Related U.S. Application Data

[63] Continuation of Ser. No. 786,771, Oct. 11, 1985, abandoned.

[51] Int. Cl.[4] ..... A47D 13/06

[52] U.S. Cl. ..... 5/99 B; 5/98 R; 5/99 A; 5/99 C

[58] Field of Search ..... 5/98 R, 98 A, 98 B, 5/98 C, 99 R, 99 A, 99 B, 99 C, 111, 112, 114

[56] References Cited

U.S. PATENT DOCUMENTS

| | | | |
|---|---|---|---|
| 336,679 | 2/1886 | Williams . | |
| 1,374,333 | 4/1921 | Stotler et al. . | |
| 2,498,203 | 2/1950 | Fischer . | |
| 2,537,903 | 1/1951 | Markowitz . | |
| 2,590,315 | 3/1952 | Hawley . | |
| 3,173,155 | 3/1965 | Schweikert . | |
| 3,183,527 | 5/1965 | Turner . | |
| 4,008,499 | 2/1977 | Wren, Jr. et al. | 5/99 C |
| 4,538,309 | 9/1985 | Gunter . | |

FOREIGN PATENT DOCUMENTS

| | | | |
|---|---|---|---|
| 703789 | 2/1931 | France | 5/98 B |
| 965135 | 9/1950 | France | 5/99 A |

*Primary Examiner*—David A. Scherbel
*Assistant Examiner*—Richard E. Chilcot, Jr.
*Attorney, Agent, or Firm*—D. W. Latham

[57] ABSTRACT

A disassemblable portable crib with a fabric crib body having a fabric floor and fabric sides and a frame suitable for supporting the fabric crib body. The frame comprises a frame base which forms a substantially planar platform held horizontally above the surface on which the crib rests and includes floor supports joined at one end to a central connector which extend beneath the floor of the crib body and feet joined at a second end of the floor supports. The frame also comprises upright corner posts joined to the frame base. The fabric crib body comprises fabric crib body sides joined with a fabric floor to form a box-like structure and means for snugly and slideably fitting the box-like crib body structure onto the corner posts such that the floor of the crib body rests on the floor supports and so that the crib body sides are tautly extended. Side stiffening members are joined to the body sides at their upper edges and extend along the entire width of the body sides. Floor stiffening members are joined to the crib body and extend across the crib floor from side to side. The resulting portable crib has significantly improved strength and rigidity over fabric bodied cribs in the prior art.

5 Claims, 2 Drawing Sheets

3
36
30
5
32
51
5
51
4
5
30
3
15
23
14
23
13
11
17
19
12
11
11
13
23
2
10

1
2
5
36
4
5
5
3

33
34
30
31
44
32
42
43
41
4
44
44
33
34
30
31

PORTABLE CRIB

This is a continuation of co-pending application Ser. No. 786,771 filed on Oct. 11, 1985, now abandoned.

BACKGROUND OF THE INVENTION

This invention relates to portable cribs and playpens for infant use and particularly to those portable cribs and playpens comprising fabric structure by which a child is supported and confined.

The prior art for cribs and playpens which are portable or at least foldable, is extensive. Many of these cribs or playpens achieve portability or foldability by means of fabric structures. For example, U.S. Pat. No. 2,537,903 issued to Markowitz discloses a highly portable fabric crib structure in which the crib comprises opposing fabric pockets defining crib ends which are adapted to fit over the backs of facing chairs and thereby support crib side panels extending between the crib end pockets by means of tension applied by the chair backs. However well suited this embodiment is with respect to portability, it is not a safe crib structure. In particular, it would be hazardous to a child who is able to stand up in the crib since as a child attempts to stand and support himself on the fabric side elements, the fabric side panels will readily flex outward. This flexing of fabric side panels would cause the center of gravity of the crib and child to shift and in some cases cause the center of gravity to shift so much that the crib would tip. Clearly, the flexibility of fabric structures can be a major obstacle to designing a safe fabric crib or fabric playpen.

A significant improvement in safety over the Markowitz patent is represented by U.S. Pat. No. 4,538,309 issued to Gunter. That patent discloses a portable playpen with a disassembable frame and a one-piece fabric body made from adjoining rectangular panels, the fabric body suspended from the frame at upright corner posts. The rigidity or flexibility of the side panels and floor are therefore determined by the amount of tension applied to them by the suspending corner posts. The amount of rigidity that can be built into this crib design is therefore limited by the strength of the fabric and seams and even more limited by the strength of the person who will be assembling it.

Unfortunately, a crib design following even the improved teachings of the Gunter patent and which can be readily assembled proves too flexible in the floor and the sides. The weight of the child alone causes the floor to flex into a substantial arc and a child placing his weight and energy onto the side panels will cause them to flex a considerable amount. While this flexing of the floor and side panels may not pose a hazard to the child, it does not make the crib or playpen comfortable for a child to stand in or move about in.

It is therefore an object of the present invention to provide a playpen or crib having a fabric design with all of the known advantages of the best fabric designs such as safety, machine washability, light weight and portability, and easy assembly and disassembly, but which also has the advantages of side and floor rigidity and strength which are more commonly associated with cribs and playpens designed from rigid materials.

BRIEF DESCRIPTION OF THE INVENTION

These and other objects are accomplished by the portable crib of the present invention. We have discovered that fabric bodied cribs of the general type taught by Gunter and by Markowitz can be provided with greatly improved floor strength and rigidity and side panel rigidity without significantly affecting portability or other desirable attributes of a fabric playpen/crib structure. In particular, we have discovered a disassemblable portable crib with a fabric crib body having a fabric floor and fabric sides and a frame suitable for supporting the fabric crib body, the portable crib comprising: (a) a frame base which forms a substantially planar platform held horizontally above the surface on which the crib rests including floor supports joined at one end to a central connector and extending beneath the floor of the crib body, and also including a plurality of feet joined at a second end of the floor supports, (b) a plurality of elongated, upright corner posts joined to the frame base, (c) a fabric crib body comprising a plurality of fabric crib body sides joined with a fabric floor to form a box-like structure, (d) means for snugly and slideably fitting the box-like crib body structure onto the corner posts such that the floor of the crib body rests on the floor supports and so that the crib body sides are tautly extended, (e) a plurality of side stiffening members, each member joined to a body side at its upper edge and extending the width of the body side, and (f) a plurality of floor stiffening members joined to the crib body and extending across the crib floor from crib side to crib side.

BRIEF DESCRIPTION OF THE DRAWINGS

To provide for further understanding of the invention and its advantages, reference will be made in the following detailed description to the accompanying drawings. Those drawings are as follows.

DETAILED DESCRIPTION OF THE PREFERRED EMBODIMENTS

Figure 1:
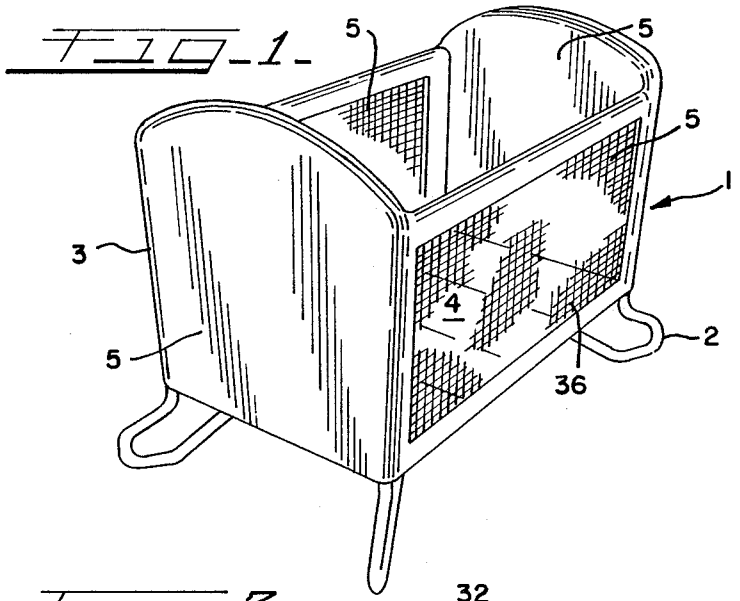
FIG. 1 is a perspective view showing a first preferred embodiment of the crib as it appears when fully assembled.

Referring now to the drawings, FIG. 1 shows a perspective view of a first preferred embodiment of the crib 1 including a frame 2 and a fabric crib body 3 having a fabric floor 4 and fabric crib sides 5. The fabric crib body is detachably and slideably joined with the frame 2. By detachably and slideably joined is meant that the fabric crib body 3 may be detached from the frame 2 by sliding the fabric crib body 3 upward until it clears the frame 2. Conversely, the fabric crib body 3 and frame 2 may be assembled to make the crib 1 by sliding the fabric crib body down over the frame 2 until the fabric crib body is firmly supported by the frame 2. Therefore, when the crib 1 is assembled, the fabric crib body 3 is supported on the frame 2 such that a downward force applied to the fabric crib body, for example by the presence of a child in the crib 1, will cause the force applied to the fabric crib body 3 to be distributed on the frame 2.

The preferred crib 1 in FIG. 1 is shown to have four sides 5. As should be readily appreciated by one skilled in the art, variants of the crib 1 shown could be made by choosing any crib configuration having three or more sides. Also as should be readily appreciated by one skilled in the art, the preferred crib 1 shown could be readily made suitable for use as a portable playpen by choosing suitable dimensions and materials for a playpen.

Figure 2:
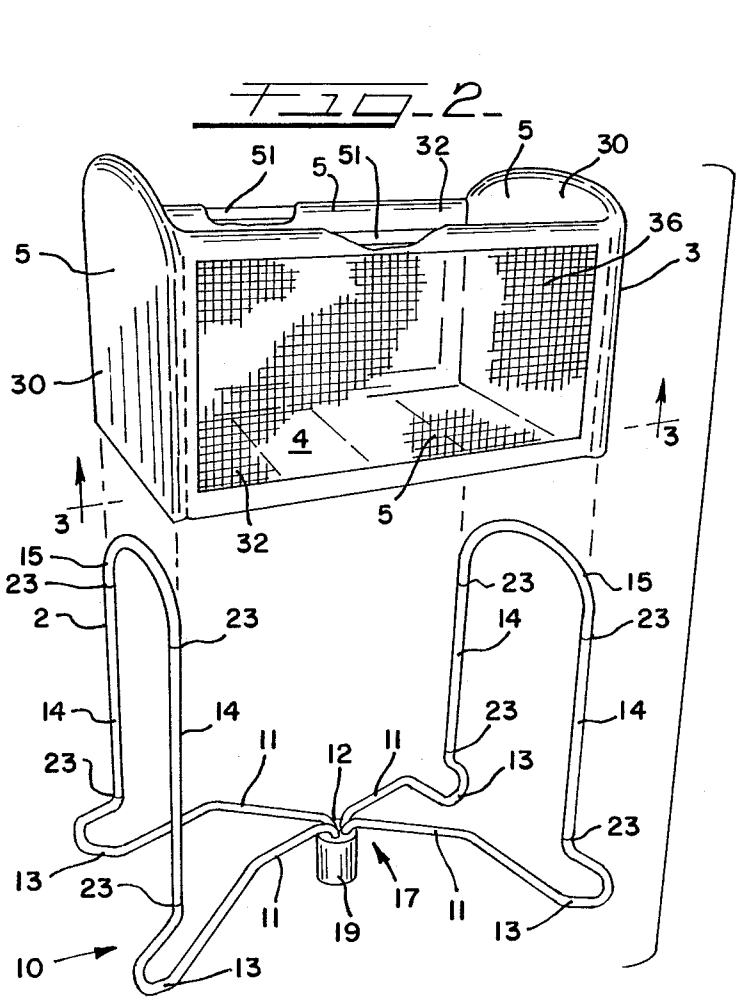
FIG. 2 is an exploded perspective view showing the supporting frame of the first preferred embodiment of the crib and the detached fabric crib body with cutaway crib sides showing side stiffening members.

Referring now to FIG. 2, FIG. 2 shows the preferred crib body 3 and the preferred frame 2 of the preferred crib 1 of FIG. 1, the frame 2 comprising a frame base 10 having floor supports 11, central connector 12, and feet 13; elongated upright corner posts 14 and post connectors 15. The frame base 10 is constructed by joining the floor supports 11 at a first end to the central connector 12 to form a planar platform 17 suitable to support the fabric floor 4 of the fabric crib body 3. The floor supports 11 are also joined at second ends to the feet 13. To complete the frame 2 construction, the elongated corner posts 14 are joined at a first end to the frame base 10 adjacent the feet 13 and the post connectors 15 are joined to a second end of adjacent corner posts 14.

The preferred central connector 12 is designed with an integral vertical support 19 which extends from the platform 17 to the surface on which the crib rests. The central connector 12 also comprises means for securing the floor supports 11. In particular, the means shown comprise vertical bores (not shown) extending downward into the central connector 12 and dimensioned to accomodate the floor supports 11. Preferably conventional key means (not shown) are used to prevent rotation of the floor support 11 on the central connector 12. This can be accomplished, for example, by placing a slot at the first end of the floor support 11 and a rib in the bore of the central connector 12 such that when the floor support 11 is joined with the central connector 12, the slot mates with the rib, preventing relative rotation. A central connector 12 of the type shown could be made from many materials but a plastic such as polypropylene is preferred.

The preferred frame 2, is shown to be made from tubular materials. For example, $\frac{7}{8}$ or $\frac{3}{4}$ inch O.D. steel tubing has been found to be satisfactory for the design of the crib 1. The floor supports 11 are joined with the central connector 12 by inserting the first end of the floor supports 11 (having a 90 degree bend) into the bores of the central connector 12 until the floor supports 11 rest on the connector 12. The floor supports 11 and the feet 13 are shown to be made in one piece by bending a single piece of steel tubing to form a floor support 11 portion and a foot 13 portion. All other connections 23 of the frame may be made by providing swaged ends which mate in a snug slideable fit with their mating frame members. These connections 23 need not be a locking type of connection since the combination of tension applied by the crib body 3 and the weight of the child in the crib 1 is adequate to prevent the connections 23 from disengaging.

As should be readily appreciated by one skilled in the art, the frame base 10 can be alternatively made from many other materials not shown in this preferred embodiment and with many other connections between the frame 2 elements also not shown. For example, instead of steel, plastics or other metals having adequate strength and rigidity could be used. The frame 2 members also need not be tubular in shape. Also, other central connector 12 designs could be used such as that shown in FIGS. 4 and 5.

Referring again to FIG. 1 and to FIG. 2, when the preferred crib 1 is assembled, the fabric floor 4 is in a position to be supported by the planar platform 17 comprising the floor supports 11 and the central connector 12. The feet 13 and central connector 12 serve to support the planar platform 17 in a generally horizontal orientation and in spaced relation to the surface on which the crib 1 rests.

Figure 3:
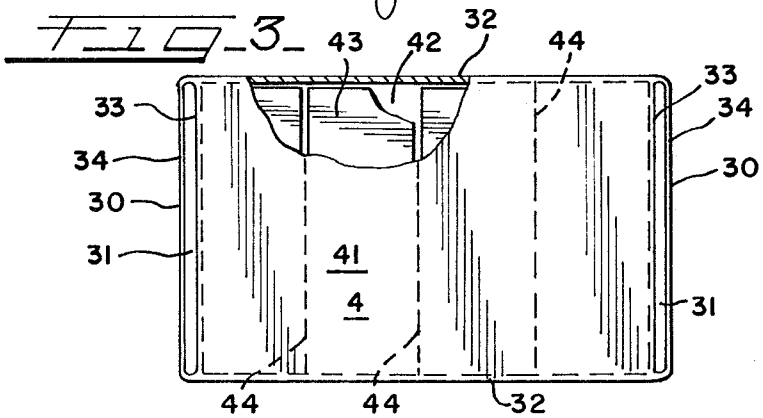
FIG. 3 is a cutaway bottom plan view of the fabric crib body.

Referring now to FIGS. 2 and 3, the crib body 3 comprises preferred fabric sides 5. The fabric sides 5 are of two types: the first type of fabric sides 30 have a pocket-like construction 31 which fits slideably and snugly over and about the corner posts 14 and post connectors 15; the second type of fabric sides 32 are fabric panels attached at each of their ends to the first type of fabric sides 30 near adjacent corner posts 14 such that they are tautly extended therebetween. Each of the first type of fabric sides 30 have an inner panel 33 and an outer panel 34. Each of the second type of fabric sides 32 is joined with each of the first type of fabric sides 30. The joints between the inner panels 33 and outer panels 34 of the first type of fabric sides and the joints between the second type of fabric sides 32 and first type of fabric sides 30 may be conventional sewn seams. Preferably, the second type of fabric sides 32 have a mesh fabric insert 36 through which light is admitted to the crib 1 and through which the child in the crib 1 may be observed.

Referring now to FIGS. 2 and 3, the preferred fabric crib body 3 also comprises a preferred fabric floor 4. The preferred fabric floor 4 (shown in a cutaway view in FIG. 3) has a lower fabric panel 41 and an upper fabric panel 42. Between the upper fabric panel 42 and lower fabric panel 41 are floor stiffening members 43. The upper fabric panel 42 and the lower fabric panel 41 are joined by seams 44 which extend across the upper fabric panel 42 and lower fabric panel 41 and form pocket structures by which the floor stiffening members 43 are confined within the fabric floor 4 and joined to the fabric crib body 3. Preferably, one end of each of the pocket structures is left open so that the floor stiffening members 43 can be removed prior to washing the fabric crib body 3. The fabric floor 4 is joined at its margins to the fabric sides 30, 32 by conventional sewn seams at the lower edge of the inner panel 33 of the first type of fabric sides 30 and also conventional sewn seams at the lower edge of the second type of fabric sides 32.

The fabric used in the preferred fabric crib body 3 is preferably a 420×420 denier nylon although it should be readily appreciated by one skilled in the art that other fabrics could also be used, such as those fabrics which are recited in prior art patents for fabric cribs and playpens. It should also be readily appreciated that the location and type of particular seams may be varied as required or even eliminated by using a single piece of fabric for more than one of the fabric panels recited. It should also be readily appreciatd that mesh fabric could be used in virtually any location on the fabric crib body 3 in addition to its use as shown on the second type of fabric sides 32.

Referring again to FIG. 2 (and especially the cutaway crib sides of FIG. 2), the fabric crib body 3 is further stiffened in the second type of fabric body sides 32 by side stiffening members 51. These side stiffening members 51 may be made from a variety of rigid materials and in a variety of configurations, but those shown in cutaway view are made from the same tubular steel as the frame 2. The side stiffening members 51 are joined with the second type of fabric body sides 32 by means of sleeves (portions of which have been cutaway in FIG. 2 to show the side stiffening members 51) extending along the entire upper edge of the second type of body sides 32. The sleeves employed may be sewn from the fabric material of the body sides 32 and are preferably open at least one end to allow the side stiffening members 51 to slide into the sleeves. Also, the side stiffening members 51 are preferably separable into two shorter lengths (not shown) to facilitate compact storage of the crib 1. This can be accomplished in a tubular structure by giving one tubular length a swaged end which will mate snugly with the second tubular length.

Assembly and disassembly of the preferred crib 1 are easily accomplished without the use of tools. In assembly, the tubing piece comprising the floor supports 11 and feet 13 are first inserted into the central connector 12 at the floor support 11 end. The lower swaged ends of the corner posts 14 are then inserted into the same tubing piece at the feet 13 end and the post connectors 15 are then inserted onto the upper swaged ends of the corner posts 14, thereby connecting adjacent corner posts and completing the frame 1. The side stiffening members 51 are then pushed into the sleeves in the body sides 32. The fabric crib body 3 is then placed onto the frame by placing each pocket-like side 30 over one post connector 15 and its supporting corner posts 14 and pulling downward on both pocket-like sides 31 until they fit snugly over and around the post connectors 15 and the corner posts 14. In disassembly, the process given above is reversed and the frame 2 and fabric crib body 3 may then be placed in a compact bag for storage or transportation. A preferred crib 1 with dimensions of about 35″×24″×38″ can be stored in a bag with dimensions of about 12″×12″×28″ by disassembling the side stiffening members 51 and by folding the crib body 3 at the seams 44 between the floor stiffening members 43.

Figure 4:
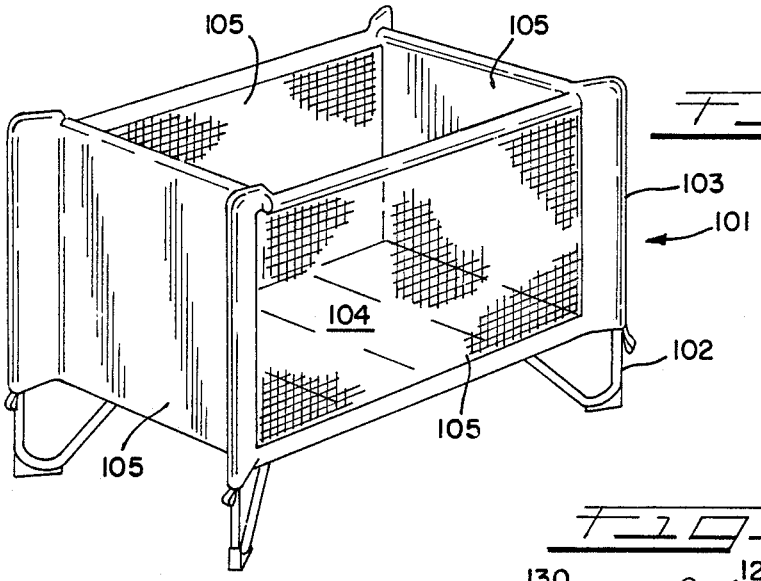
FIG. 4 is a perspective view showing a second preferred embodiment of the crib as it appears when fully assembled.
Figure 5:
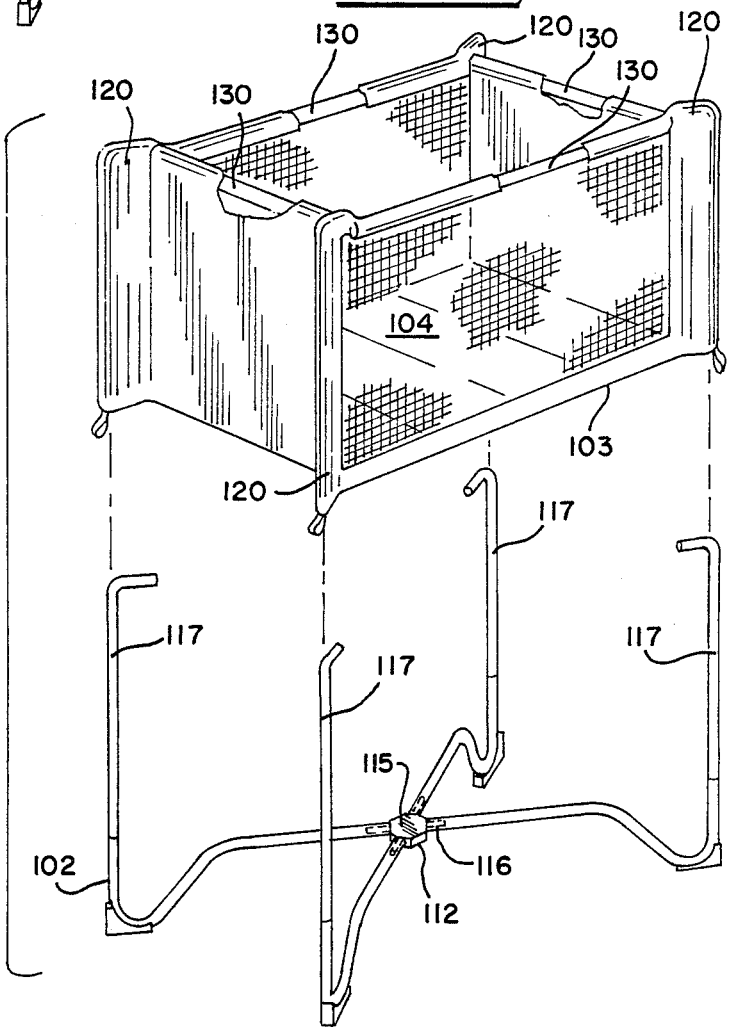
FIG. 5 is an exploded perspective view showing the supporting frame of the second preferred embodiment of the crib and the detached fabric crib body with cutaway crib sides showing side stiffening members.

It should be readily appreciated by those skilled in the art that the preferred embodiment disclosed as the crib 1 of FIG. 1 is not the only portable crib or portable playpen embodiment in which the present invention will be operable. To further define the present invention, a second preferred crib embodying the present invention is also presented herein. FIGS. 4 and 5 show a crib which has features similar to features employed in the playpen disclosed in the Gunter patent but which also embodies the present invention. For those features recited in detail in the Gunter patent, the Gunter patent (U.S. Pat. No. 4,538,309) is hereby incorporated by reference.

FIG. 4 shows the second preferred, assembled crib 101 comprising a frame 102 and a fabric crib body 103 having a fabric floor 104 and fabric crib sides 105. Referring also to FIG. 5, the fabric crib body 103 is detachably and slideably joined with the frame 102 as described above with respect to the first crib embodiment except with respect to the frame 102 which lacks post connectors 15 shown in FIG. 2 and also with respect to the central connector 112 which has a different configuration than the central connector 12 shown in FIG. 2. The second preferred central connector 112 differs from the first preferred central connector 12 shown in FIG. 2 in that it has a central body 115 and rigid, fixed flanges 116 made, for example from aluminum, and extending radially from the central body 115 which are adapted to mate with the steel tubing of the frame 102. Further discussion of this type of connector is given in the Gunter patent. One other minor difference in the second preferred frame 102 from the first preferred frame 2 of FIG. 2 is the curved upper ends of corner posts 117. These curved upper ends provide additional surface area to better distribute forces on the fabric crib body 103 where it is supported on the corner posts 117.

The second preferred fabric crib body 103 has a fabric floor 104 and fabric crib sides 105 which form a box-like structure. Fabric sleeve-like members 120 extend outwardly from the fabric crib sides 105 and extend outwardly from the box-like structure onto the corner posts 117 such that the box-like structure is supported on the corner posts 117 by vertically extending web-like members between the corner posts 117 and the box-like fabric structure. A more detailed description of similar web-like members and a similar box-like structure is given in the Gunter patent. The second preferred fabric floor 104 has the same construction as the first preferred fabric floor 4 in FIG. 3; both having the same construction of floor stiffening members 43 shown in the first preferred crib embodiment in FIGS. 1 and 3.

Referring again to FIG. 5, the second preferred fabric crib body 103 is also stiffened in the body sides 105 by side stiffening members 130 (shown in cutaway view in FIG. 5). These side stiffening members 130 are in principal and operation the same as the side stiffening members 51 shown in FIGS. 1 and 2, including the same type of sleeves (shown cutaway in FIG. 5 to display side stiffening members 130) used to join the side stiffening members 51 to the body sides 32. The use of side stiffening members 130 in the second preferred crib embodiment differ significantly from that in the first preferred crib embodiment only in that the side stiffening members 130 are employed on all four sides of the crib.

Assembly, disassembly and storage of the second preferred crib embodiment is substantially the same as described above for the first preferred crib embodiment.

As will be readily recognized by one with ordinary skill in the art, a crib constructed as described herein is considerably stronger and more rigid than the fabric crib structures heretofore disclosed by Gunter and Markowitz in the prior art. This is due to the unique combination of frame support for the crib body floor together with the provision of stiffening members on the floor and body sides. These elements work in combination when a child is placed in the crib. When the child is in the center of the crib 1, whether laying or standing, the frame base 10 resists flexing of the floor 4 and the floor stiffeners 43 distribute the weight of the child over the frame base floor supports 11. When the child stands at the crib sides 32, the floor stiffeners 43 distribute the weight of the child along the floor supports 11 and along the joint between the crib side 32 and the crib floor 4 and the side stiffeners 51 distribute the downward forces pulling down the crib side 32 along the entire top edge of the side 32 and especially concentrate those forces near the corner posts 14, the main supports for the entire crib body structure. When the child pulls or pushes on the crib sides 32, the forces applied to the crib sides 32 are again distributed away from the center of the side 32 and concentrated near the corner posts 14. It can be readily recognized from this discription that forces applied by the child are transferred to the rigid frame 2 rather than being concentrated on the soft crib body 3. It can also be readily recognized from this description that the crib structure recited would work equally well as a playpen for an active child. In fact, the advantages provided in a playpen design by the more rigid structure would probably be greater than the same advantages provided in a crib design. Therefore, when the word "crib" is used herein, it also means "playpen."

These stiffening and support elements need not increase the weight or bulk of the crib significantly. Since the elements work in combination to provide increased rigidity to the crib, no single element in itself is required to be especially strong or exceptionally rigid. For example, 1/8 inch hardboard should be adequate in most applications for the floor stiffeners 43 and the side stiffeners 51 used can usually be relatively small diameter, thin gage steel tubing.

These stiffening elements 43, 51 also need not significantly affect portability and ease of assembly of the crib. For example, the floor stiffening elements 43 can be designed into the crib body 3 so that the crib body 3 can be folded between adjacent stiffeners 43 and the side stiffeners 51 can be designed to be easily removed from the sides 32 prior to folding the crib body 3.

These stiffening elements also need not diminish the washability of the fabric crib body 3 since they are easily joined with the crib body 3 in sleeves or pockets from which they can be easily removed prior to washing.

The two preferred crib embodiments described above therefore provide a disclosure of the invention which one skilled in the art will recognize as a significant improvement in the art for fabric-bodied portable cribs. The features of portability, light weight construction, compact storage, and washability which are well known advantages of fabric-bodied cribs are maintained in the present invention while the strength and rigidity of fabric-bodied cribs are greatly improved.

Although the above description of the invention and preferred embodiments of the invention are disclosed herein for the purpose of describing the invention to those skilled in the art, each and every modification and variation of the invention is not described in detail. It is intended, however, that all modifications and variations within the scope of the claims are to be included within the scope of the invention.

We claim:

1. In a portable crib having a box-like fabric crib body and a frame, said fabric crib body having a plurality of fabric sides and a fabric floor, said frame having elongated upright corner posts by which the fabric crib body is supported and tensioned such that the portable crib may be disassembled by sliding the fabric crib body upward relative to the corner posts until the fabric crib body is disengaged from the frame, wherein the improvement comprises:

a. rigid floor support means integral with the frame, said rigid floor support means supporting the fabric floor;

b. floor stiffening means joined with the fabric floor; and c. side stiffening means joined with a fabric body side adjacent a fabric body side upper edge;

said rigid floor support means, said floor stiffening means and said side stiffening means cooperating to provide support for a child placed into the portable crib.

2. The portable crib of claim 1 wherein the floor support means comprises:

a. a plurality of elongated floor supports, each floor support having a first end and a second end;

b. a central connector comprising means for joining the plurality of floor supports, each floor support joined with the connector at its first end to form a stable, substantially planar platform, each of the floor supports extending beneath the floor of the crib body and supporting the floor of the crib body; and c. a plurality of feet, each foot joined to the second end of a floor support and supporting the platform comprising the floor supports in a substantially horizontal orientation in spaced relation to a surface on which the crib rests.

3. The portable crib of claim 1 wherein the floor stiffening means comprises a floor stiffening member, the floor stiffening member joined to the crib body in a pocket-like member integral with the fabric floor and extending across the fabric floor from a first edge to a second edge.

4. The portable crib of claim 1 wherein the side stiffening means comprises a side stiffening member slideably engaged within a sleeve-like member adjacent a body side upper edge and extending along the body side upper edge from a first end adjacent a first corner post to a second end adjacent a second corner post.

5. The portable crib of claim 2 wherein a vertical support is centrally joined to the platform comprising the floor supports, the vertical support extending from the platform comprising the floor supports to the surface on which the crib rests.

* * * * *